US006183170B1

(12) United States Patent
Wald et al.

(10) Patent No.: US 6,183,170 B1
(45) Date of Patent: Feb. 6, 2001

(54) CYLINDRICAL CUTTING DEVICE

(75) Inventors: Wolfgang Wald, Rasdorf; Martina Stuckardt, Haunetal; Ernst Heiderich, Hohenroda; Reinhold Walter, Rosdorf, all of (DE)

(73) Assignee: Boart Longyear GmbH & Co. KG Hartmetallwerkzeugfabrik, Burghaun (DE)

( * ) Notice: Under 35 U.S.C. 154(b), the term of this patent shall be extended for 0 days.

(21) Appl. No.: 09/273,298

(22) Filed: Mar. 19, 1999

(30) Foreign Application Priority Data

Mar. 19, 1998 (DE) ..... 298 05 007 U

(51) Int. Cl.[7] ..... B26D 1/00

(52) U.S. Cl. ..... 407/46; 407/56; 407/101; 407/102; 299/109

(58) Field of Search ..... 407/101, 46, 56, 407/33, 35, 43, 53, 102; 299/87.1, 102, 109

(56) References Cited

U.S. PATENT DOCUMENTS 530,793 * 12/1894 Odgers ..... 407/60 X
2,965,365 * 12/1960 Krekeler ..... 299/109
3,092,374 * 6/1963 Krekeler ..... 299/109
3,285,668 * 11/1966 Fearon ..... 299/109
3,575,467 * 4/1971 Davis ..... 299/109
4,057,294 * 11/1977 Krekeler ..... 407/101 X
4,337,980 * 7/1982 Krekeler ..... 407/46 X

FOREIGN PATENT DOCUMENTS 4322402 6/1996 (DE) .

* cited by examiner

*Primary Examiner*—Henry Tsai
(74) *Attorney, Agent, or Firm*—Jordan and Hamburg LLP

(57) ABSTRACT

A chisel holder is connected exchangeably in a fixed manner to at least one base mount disposed on a surface of a cylindrical cutting device, such as a cutting machine or a line milling machine, in a manner obviating use of a threaded setscrew. A borehole extends through the base mount, and a securing bolt received therein grips at least regionally through or behind an aligned recess formed in the chisel holder. The securing bolt is then clamped or locked to the base mount without use of threads.

13 Claims, 2 Drawing Sheets

CYLINDRICAL CUTTING DEVICE

BACKGROUND OF THE INVENTION

The present invention relates to a cylindrical cutting device, and more particularly to a cutting machine or a line milling machine in which a chisel holder or like tool is removably secured to a base carried on the machine.

As a rule, such cutting devices have a plurality of bases disposed on their surface at a uniform spacing, and form, for example, a broach-loading screw or a broach spiral. In this connection, a chisel holder with an exchangeable chisel is connected to each base or, in some bases, an appropriately fitting chisel is inserted directly without having a chisel holder as an intermediate element.

A known cutting device of this type is disclosed for example in DE 43 22 402 C2. In the disclosed device, a chisel holder includes a shaft which is introduced into a plug-in receptacle of a base, and is referred to as a plug-in attachment. To prevent the chisel holder from being pulled out, the chisel holder is secured in the base with a setscrew, which can be actuated by means of a recessed hexagonally shaped tool receptacle and which setscrew engages an assigned recess of the shaft of the chisel holder.

The above method of securing the chisel holder has a disadvantage in that an internal thread of a borehole which extends through the base, and the hexagonal recess of the setscrew which serves to accommodate a tool, are susceptible to contamination especially when a cutting operation of the cutting device creates an abundant amount of dust. As a consequence, it becomes increasingly difficult to loosen the setscrew in order to exchange the chisel holder.

The present invention is therefore concerned with the problem of providing a cutting device of the above type, for which the chisel holder or holders, or like tools, are secured in a simple manner not susceptible to contamination and, accordingly, can be loosened easily when required.

SUMMARY OF THE INVENTION

In accordance with these and other objects of the invention, there is provided a cylindrical cutting device which includes at least one base mount disposed on a surface thereof. A borehole is formed extending through the base mount, in which a securing bolt is receivable. A chisel holder is provided for exchangeable securement to the base mount. A recess is formed in the chisel holder such that, when the securing bolt is inserted in the borehole, a portion of the securing bolt at least regionally engages the recess, preventing separation of the chisel holder from the base mount. The securing bolt is detachably secured to the base mount by a press-fitting or other locking structure in a manner advantageously avoiding the use of threads.

By virtue of the fact that the securing bolt is not constructed as a setscrew, pursuant to the present invention, it is held without threads by being jammed or locked in the borehole formed in the base mount. As a result, there are no threads which are subject to contamination in the base mount and, with that, there is also no danger that such threads will be clogged with foreign objects and make it difficult to loosen and exchange the chisel holder.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
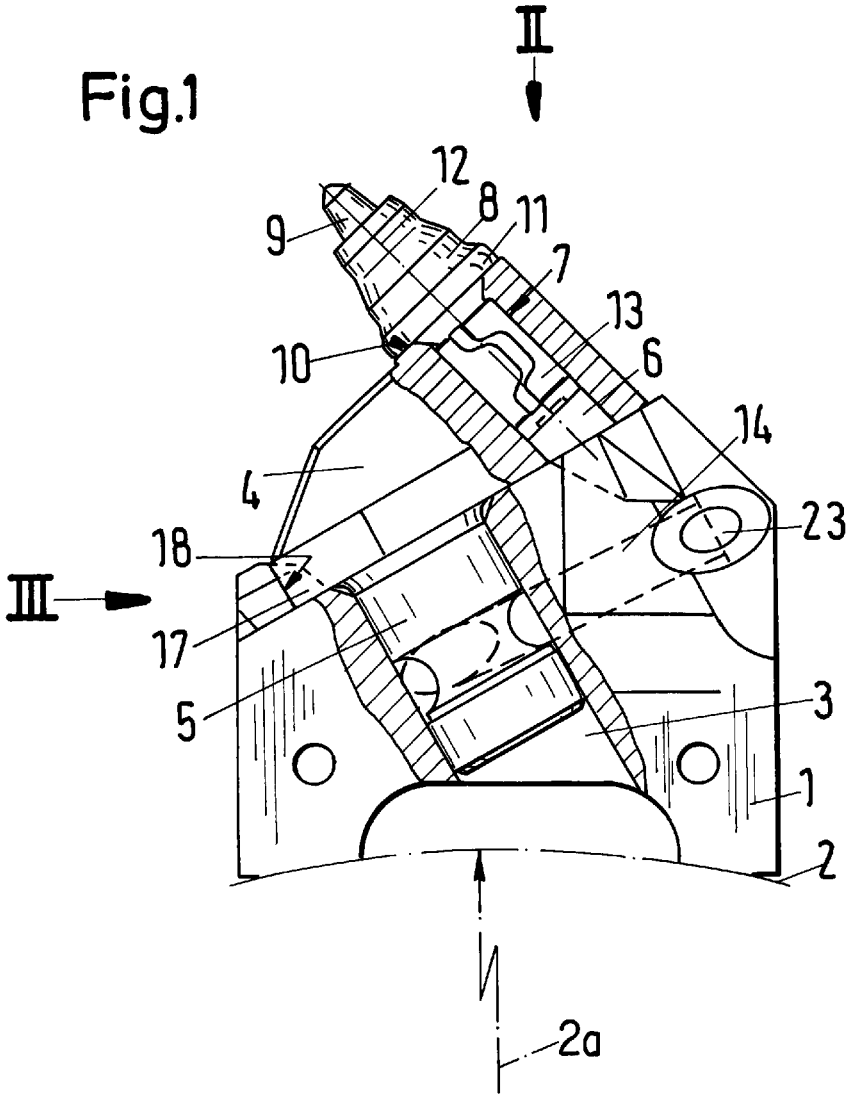
FIG. 1 is a side view in partial cross-section of a base mount with a chisel holder and a chisel.

Referring now to the figures, and in particular FIG. 1, a base mount 1 is depicted having an underside which is curved concavely and thus adapted to cutting device cylindrical surface 2 of the cutting device indicated by broken lines as is its access 2*a* and to which the base mount 1 is fastened, for example, by a welded connection. The body of the base mount 1 has a plug-in receptacle 3. A chisel holder 4 has a shaft 5 which is integrally molded with the chisel holder 4 and which is received in the plug-in receptacle 3. The chisel holder 4 comprises a chisel receptacle 6, which accommodates a shaft part 7 of a chisel 8. At a side of the chisel receptacle 6 facing a chisel head 9, a contact surface 10 is formed, at which the chisel 8 is supported by a shoulder 11. A toggle-type fastener 13 prevents the chisel 8 from being pulled out in the direction of its axis 12.

A through-hole 14 accommodates a securing bolt 15 and extends through the base mount 1. As can be seen most clearly in FIG. 3, in which the chisel holder 4 with the chisel 8 is shown separated from the base mount 1 and above the base mount 1, the shaft 5 of the chisel holder 4 has a recess 16 which is alignable with the borehole 14 in the base mount 1 when the shaft 5 is inserted in the plug-in receptacle 3. The recess 16 is constructed, in the example of the embodiment shown, as a peripheral annular groove open at the side. In the position in which it is introduced into the base mount 1, the securing bolt 15 grips regionally behind the shaft 5 of the chisel holder 4, engaging the recess 16, and thus prevents the chisel holder 4 from becoming detached from the base mount 1. In this connection, the construction of the recess 16, which is open at the side, is more advantageous than that of a recess which passes completely through the shaft 5, since shear forces which act on the securing bolt 15 are less in the case of the embodiment shown in the event that play develops between the chisel holder 4 and the base mount 1. When the recess 16 is constructed as an annular groove disposed at least partially around the shaft 5, shear forces acting on the securing bolt 15 are avoided even if the chisel holder 4 were to twist. For manufacturing reasons, the construction of the recess 16 as an annular groove disposed completely around the shaft 5 is particularly advantageous. In the case of the embodiment shown, the chisel holder 4 is then prevented from twisting, in that it is held by a nose-like region 17 engaging a locating surface 18 of the base mount 1.

Figure 2:
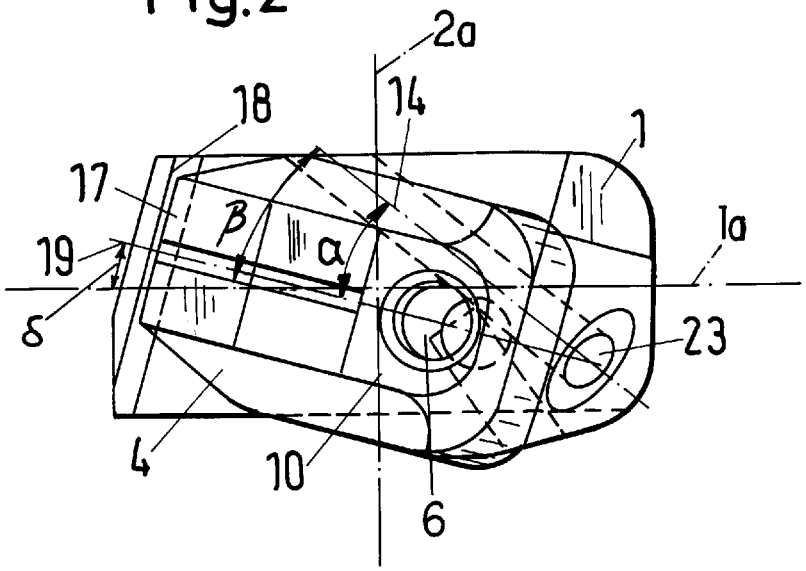
FIG. 2 is a top view from the direction II in FIG. 1, depicted without the chisel.

Referring to FIG. 2, which represents a radial view of the cutting device depicted without a chisel, the borehole 14 extends at an acute angle $\alpha$ to a longitudinal plane 19 of the chisel holder 4 and also extends at an acute $\beta$ relative to a plane 1*a* which is perpendicular to the cylindrical axis 2*a*. By means of this arrangement, the load acting during the operation of the cutting device on the securing bolt 15 disposed in the borehole 14 is distributed uniformly over the securing bolt 15. Also as can be seen in FIG. 2, the longitudinal axis 19 of the chisel holder 4 extends at an acute angle $\delta$ angle relative to the aforementioned plane 1*a*.

In the case of the embodiment shown, the securing mechanism is constructed as a clamping device, the securing bolt 15 being held in the borehole 14 by a press fit. This has the advantage that the borehole can be configured completely smooth on the inside, so that contaminating particles do not adhere to its walls. The securing mechanism can, however, also be constructed as a locking device, for example, in the form of a bayonet catch.

Figure 3:
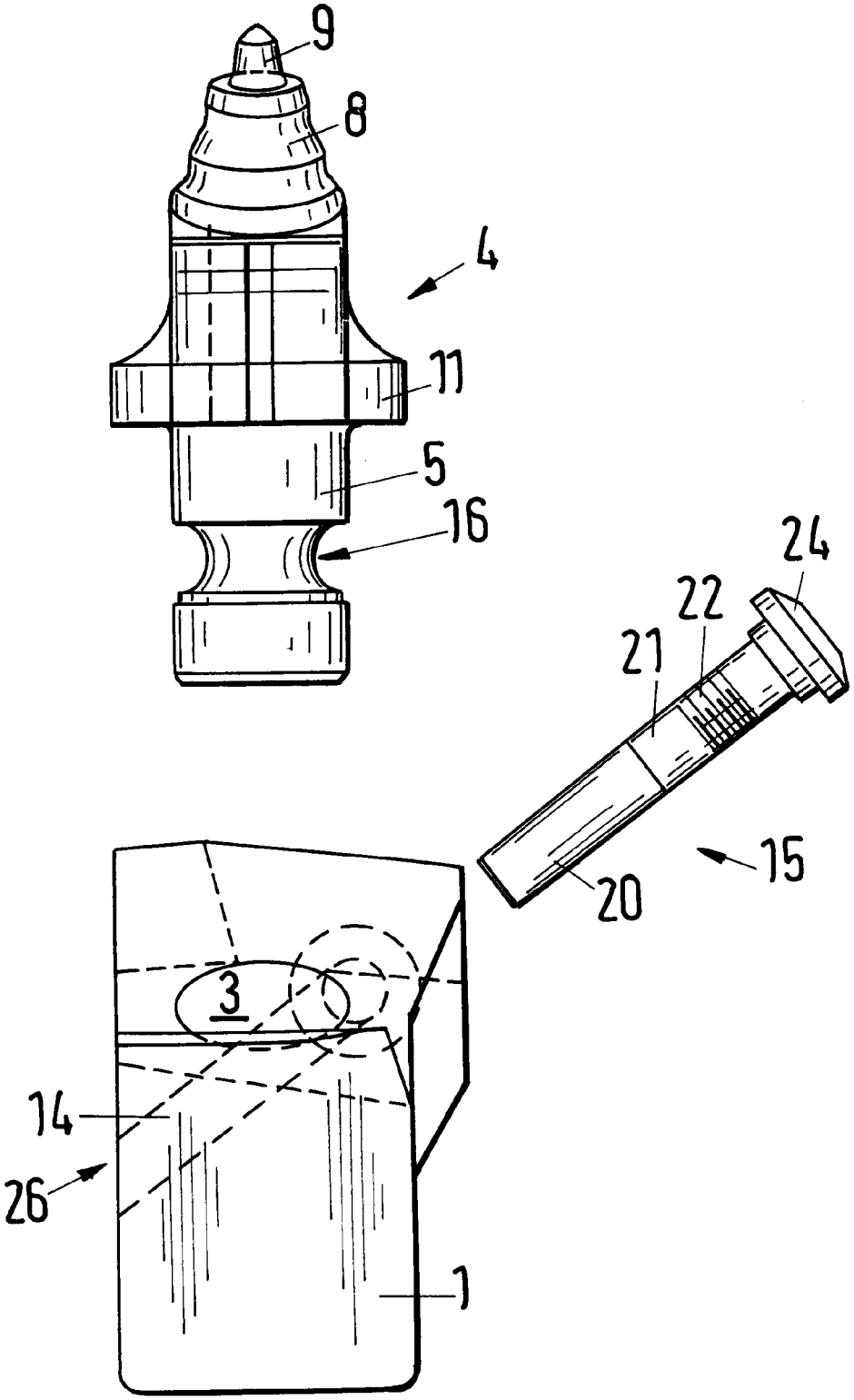
FIG. 3 is an exploded front view from the direction III in FIG. 1.

The securing bolt 15, as shown in FIG. 3, has a conical front part 20 which facilitates the introduction into the borehole 14, and a rear part 21 with a cylindrical surface. In the rear part 21, regions of the surface are deformed elastically, the elastically deformable region in the undeformed state being over dimensioned with respect to the borehole 14, thus bringing about the clamping action of the press fit. Advantageously, the elastically deformable region is formed by a sleeve 22, as shown. In particular, the sleeve 22 may advantageously consist of a suitable plastic. The sleeve 22 can also be developed exchangeably, in that it is pushed, for example, with slight expansion, over the securing bolt 15. For this purpose, the core of the securing bolt 15 in the region of the sleeve 22 can have a smaller diameter so that upper and lower contacting surfaces are formed, which prevent the sleeve 22, which is pushed onto the securing bolt 15, from slipping to one side. Use of such an exchangeable sleeve 22 allows replacement thereof when worn, without having to replace the whole of the securing bolt 15. It is also possible to replace the sleeve 22 by a sleeve of larger external diameter, should play have developed between the borehole 14 or the recess 16 of the chisel holder 4 and the securing bolt 15 during the operation of the cutting device.

The securing bolt 15 shown includes a bolt head 24 at a rear end thereof which, in an installed state, covers a rear outlet opening 23 of the borehole 14. Such construction further decreases the danger that contamination will penetrate into the borehole 14. In addition, during assembly, the securing bolt 15 can be pressed into the borehole 14 as far as the bolt head 24 without the risk of driving the securing bolt 15 through the borehole 14. In order to undo the securing mechanism, the securing bolt 15 is driven out of the borehole 14 with a suitable tool from an opposite outlet opening 26. Alternatively, the bolt head 24 can serve for undoing the securing mechanism. For this purpose, it may have, for example, recesses which can be engaged by a suitable tool in order to pull out the securing bolt 15.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method for securing a tool having a longitudinal axis to a base mount carried on a cylindrical cutting device, comprising:

providing said base mount with a tool receptacle for slidably receiving at least a portion of the tool;

forming a recess in said portion of the tool at least slidably receivable in the tool receptacle;

providing a securing member for securing the tool in said base mount;

forming a borehole in said base mount for receiving said securing member removably therein, said borehole at least partially intersecting said tool receptacle so as to align at least a portion of said securing member in said recess to prevent removal of the tool, and said borehole extending with respect to said longitudinal axis of the tool so as to define an acute angle in a radial projection view of said cylindrical cutting device; and inserting said securing member into said borehole to effect at least regional engagement with said recess.

2. The method according to claim 1, further comprising the step of securing the securing member to the base mount without threaded engagement.

3. A cutting device for mounting on a cylindrical surface (2) of a cylindrical cutting apparatus having a cylindrical axis (2*a*), the cutting device comprising a base structure (1) mounted on said cylindrical surface (2) of the cylindrical cutting apparatus, said base structure (1) having a receiving opening (3), a tool holder (4) having a mounting portion (5) disposed in said receiving opening (3), said tool holder (4) being a longitudinal extending tool holder having a tool holder longitudinal plane (19) which is disposed at an acute angle (δ) relative to a plane (1*a*) perpendicular to said cylindrical axis (2*a*), said base structure having an elongate passage (23), a securing member (15) in said elongate passage (23), said mounting portion (5) of said tool holder (3) having a recess (16) which is at least partially engaged by said securing member (15) to prevent removal of said tool holder (4) from said base structure (1).

4. A cutting device according to claim 3 wherein said tool holder longitudinal plane (19) generally bisects said tool holder (4).

5. A cutting device for mounting on a cylindrical surface (2) of a cylindrical cutting apparatus having a cylindrical axis (2*a*), the cutting device comprising a base structure (1) mounted on said cylindrical surface (2) of the cylindrical cutting apparatus, said base structure (1) having a receiving opening (3), a tool holder (4) having a mounting portion (5) disposed in said receiving opening (3), said tool holder (4) having a bisecting plane (19) which generally bisects said tool holder (4) and which is disposed at an acute angle (δ) relative to a plane (1*a*) perpendicular to said cylindrical axis (2*a*), said base structure (1) having an elongate passage (23) having an elongate axis (14), a securing member (15) in said elongate passage (23), said mounting portion (5) of said tool holder (4) having a recess (16) which is at least partially engaged by said securing member (15) to prevent removal of said tool holder (4) from said base structure (1).

6. A cutting device for mounting on a cylindrical surface (2) of a cylindrical cutting apparatus having a cylindrical axis (2*a*), the cutting device comprising a base structure (1) mounted on said cylindrical surface (2*a*) of the cylindrical cutting apparatus, said base structure (1) having a receiving opening (3), a tool holder (4) having a mounting portion (5) disposed in said receiving opening (3), said tool holder (4) being a longitudinal extending tool holder having a tool holder longitudinal plane (19) which is disposed at an acute angle (δ) relative to a plane (1*a*) which is perpendicular to said cylindrical axis (2*a*), said base structure (1) having an elongate passage (23) having an elongate axis (14), a securing member (15) in said elongate passage (23), said mounting portion (5) of said tool holder (4) having a recess (16) which is at least partially engaged by said securing member (15) to prevent removal of said tool holder (4) from said base structure (1), said elongate axis (14) of said elongate passage (23) being disposed at an acute angle (α) relative to said longitudinal plane (19) of said tool holder (4).

7. A cutting device according to claim 6 wherein said longitudinal plane (19) of said tool holder generally bisects said tool holder (4).

8. A cutting device according to claim 6 wherein said elongate axis (14) of said elongate passage (23) is disposed at an acute angle (β) relative to a plane (1*a*) perpendicular to said cylindrical axis (2*a*).

9. A cutting device according to claim 6 wherein said base structure (1) is a longitudinally extending base structure having a base structure longitudinal axis (1*a*) included in a plane (1*a*) perpendicular to said cylindrical axis (2*a*).

10. A cutting device for mounting on a cylindrical surface (2) of a cylindrical cutting apparatus having a cylindrical axis (2*a*), the cutting device comprising a base structure (1) mounted on said cylindrical surface (2) of the cylindrical cutting apparatus, said base structure (1) being a longitudinally extending base structure having a base structure longitudinal axis (1*a*) included in a base structure plane (1*a*) perpendicular to said cylindrical axis (2*a*), said base structure (1) having a receiving opening (3), a tool holder (4) having a mounting portion (5) disposed in said receiving opening (3), said tool holder (4) being a longitudinally extending tool holder having a tool holder longitudinal plane (19) disposed at an acute angle (δ) relative to a plane (1*a*) perpendicular to said cylindrical axis (2*a*) , said base structure (1) having an elongate passage (23) having an elongate axis 14), a securing member (15) in said elongate passage (23), said mounting portion (5) of said tool holder (4) having a recess (16) which is at least partially engaged by said securing member (15) to prevent removal of said tool holder (4) from the base structure (1), said elongate axis (14) of said elongate passage (23) being disposed at an acute angle (β) relative to said base structure plane (1*a*) and being disposed at an acute angle α (α) relative to said tool longitudinal plane (19).

11. A cutting device according to claim 10 wherein the acute angle (β) between said elongate axis (14) and said base structure plane (1*a*) is different from the acute angle (α) between said elongate axis (14) and said tool holder longitudinal plane (19).

12. A cutting device according to claim 10 wherein said tool holder longitudinal plane (19) generally bisects said tool holder (4).

13. A cutting device according to claim 10 wherein said base structure plane (1*a*) generally bisects said base structure (1).

* * * * *